US008884174B2

(12) United States Patent
Chou

(10) Patent No.: US 8,884,174 B2
(45) Date of Patent: Nov. 11, 2014

(54) LOCALLY ILLUMINATED KEYCAP

(71) Applicant: Zippy Technology Corp., New Taipei (TW)

(72) Inventor: Chin-Wen Chou, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 155 days.

(21) Appl. No.: 13/706,106

(22) Filed: Dec. 5, 2012

(65) Prior Publication Data

US 2014/0151205 A1 Jun. 5, 2014

(51) Int. Cl.
*H01H 9/00* (2006.01)
*H01H 13/02* (2006.01)

(52) U.S. Cl.
CPC ..... *H01H 13/023* (2013.01)
USPC ..... 200/314

(58) Field of Classification Search
USPC ..... 200/310–314, 317, 5 A, 512–521, 200/344–345; 362/556, 554, 555, 558, 559, 362/616, 26, 27
See application file for complete search history.

(56) References Cited

U.S. PATENT DOCUMENTS

| | | | | |
|---|---|---|---|---|
| 6,765,503 | B1 * | 7/2004 | Chan et al. | 341/22 |
| 7,847,204 | B2 | 12/2010 | Tsai | |
| 8,404,984 | B2 * | 3/2013 | Liu | 200/5 A |
| 2012/0298491 | A1 * | 11/2012 | Ozias et al. | 200/314 |

FOREIGN PATENT DOCUMENTS

| | | |
|---|---|---|
| TW | I283421 B | 7/2001 |
| TW | 200745915 | 12/2007 |
| TW | I340402 | 4/2011 |
| TW | M419150 U | 12/2011 |

* cited by examiner

*Primary Examiner* — Edwin A. Leon
(74) *Attorney, Agent, or Firm* — Muncy, Geissler, Olds & Lowe, P.C.

(57) ABSTRACT

A locally illuminated keycap is located in a keyboard. The keyboard includes a lighting unit to project light to the keycap. The keycap includes at least one top edge to form an opaque press surface, at least one bottom edge located below the press surface to form a light incident surface to receive light, and at least one transparent light emitting surface connecting to the top edge and bottom edge to emit light. The press surface and light emitting surface form an inclined angle between them greater than 90 degrees. The press surface, light incident surface and light emitting surface jointly form a light retaining zone. Light generated by the lighting unit projects to the light incident surface and enters the light retaining zone, and is masked by the opaque press surface to emit locally through the transparent light emitting surface.

12 Claims, 6 Drawing Sheets

LOCALLY ILLUMINATED KEYCAP

FIELD OF THE INVENTION

The present invention relates to a keycap and particularly to a keycap containing an opaque press surface and a transparent light emitting surface below the press surface to emit light locally.

BACKGROUND OF THE INVENTION

Illuminated keyboard aims to solve the problem of users of unable to clearly distinguish notations and characters on the keycaps in a dark environment. To improve illumination characteristic of the illuminated keyboard, light transmission architecture and keycap structure are two main issues that have to be seriously focused. Compared with the more complex light transmission architecture, keycap is simpler in structure. The keycap mainly includes a press surface and a plurality of inclined surfaces extended from the press surface. Hence through a simple improvement a great effect can be accomplished.

Many prior techniques concerning improvement of the keycap focused on light emission structure of the press surface. For instance, Taiwan publication No. 200745915 proposes an opaque keycap with a transparent character notation formed thereon to highlight the character notation. U.S. Pat. No. 7,847,204 discloses a keycap with four different transparent colored layers respectively at four corners of the press surface. Taiwan utility model No. M419150 discloses a keycap having a press surface with a transparent portion to allow light to transmit. They all have the disadvantage of occupying too much area on the keyboard by the press surface of the keycap. With the light concentrating on the press surface for emission the entire keyboard is illuminated that makes distinguishing individual keycaps difficult.

There are other types of keycap structures that do not emit light through the press surface, such as Taiwan patent No. I283421. It discloses a backlit key assembly which includes an opaque key and a light guide element surrounding the key. It transfers the lighting element from the traditional press surface to the light guide element such that a ring of bright backlight is presented around the key. But it requires adding an extra light guide element around the key and results in the disadvantages of a higher cost and more complex fabrication and assembly processes.

Another Taiwan patent No. I340402 discloses a keycap capable of emitting light laterally. The keycap has a light incident surface at the bottom and a light emitting surface at one lateral side. The light emitting surface has a refractive surface corresponding to the keycap. When light projects to the light incident surface and is guided by the refractive surface to the light emitting surface, it emits laterally via the light emitting surface and projects to an identification zone corresponding to the keycap. Although it can emit light laterally, the conventional keyboard has the notations and characters located on the keycaps rather than on the identification zone. The transverse light cannot travel longitudinally to illuminate the notations and characters on the keycaps, hence it is not suitable for the conventional illuminated keyboards.

SUMMARY OF THE INVENTION

The primary object of the present invention is to overcome the disadvantage of the conventional illuminated keyboards of emitting light through the press surface that causes total illumination and resulting in not distinguishable of the locations of individual keycaps.

To achieve the foregoing object, the present invention provides a locally illuminated keycap located in a keyboard. The keyboard includes a command circuit board that is located beneath the keycap and triggered by a vertical movement of the keycap to issue a keyboard command signal. The keyboard also has a lighting unit to provide light and project the light to the keycap. The keycap includes at least one top edge to form an opaque press surface, at least one bottom edge located below the press surface to form a light incident surface to receive light, and at least one transparent light emitting surface connecting to the top edge and bottom edge to emit light. The light emitting surface is located between the press surface and light incident surface. The press surface and light emitting surface form an inclined angle between them greater than 90 degrees. The press surface, light incident surface and light emitting surface jointly form a light retaining zone. Light from the lighting unit enters the light retaining zone and is masked by the opaque press surface to emit locally through the transparent light emitting surface.

In one embodiment the keyboard further includes a light mask unit located between the lighting unit and keycap.

In another embodiment the light mask unit includes a transparent zone located beneath the light incident surface and formed at an area smaller than that of the light incident surface so that the light from the lighting unit projects to the light incident surface through the transparent zone and enter the light retaining zone.

In yet another embodiment the command circuit board has a reflective portion corresponding to the transparent zone.

In yet another embodiment the light mask unit is a light mask plate.

In yet another embodiment the light mask unit is a light mask layer coated on the command circuit board.

In yet another embodiment the press surface is coated with an opaque layer or made of an opaque material.

In yet another embodiment the light emitting surface is made of a transparent material.

In yet another embodiment the keycap has a transparent character or a transparent notation to allow the light to transmit through the press surface.

In yet another embodiment the keyboard includes a baseboard to hold the keycap.

In yet another embodiment the keyboard includes a driven mechanism to bridge the baseboard and keycap, and an elastic element located in the driven mechanism to allow the keycap to move up and down against the baseboard to trigger the command circuit board.

Through the aforesaid structure, compared with the conventional techniques, the invention can provide at least the following advantages:

1. The location of each keycap is distinguishable clearly. With the press surface of the keycap being opaque and the light emitting surface below the press surface being transparent, after the light projects to the light incident surface, it is masked by the press surface but emits locally through the light emitting surface, hence a light halo is formed around the keycap to facilitate identification thereof. Compared with the conventional illuminated keyboard that emits light on the entire press surface, the locations of individual keycaps of the invention can be clearly identified.

2. Each keycap has a higher luminosity locally. The invention, with the light mask unit located between the lighting unit and keycap and including a transparent zone which is located beneath the light incident surface and formed at an area smaller than that of the light incident surface, a greater portion of the light can directly project through the transparent zone to the light incident surface and enter the light retaining zone, thus only a small portion of the light does not project to the light incident surface but scatters outside.

3. Fabrication process is simpler and the cost is lower. Compared with the conventional keycap with illumination occurred to the surrounding thereof, the invention does not need an extra light guide element to surround the keycap. Hence fabrication process is simplified and the cost can be reduced.

4. The light emitted from the keycap is not masked by user's fingers. Since the keycap of the invention does not emit light from the press surface, during user's keystroke operation illumination of the keycap is not affected by masking of the press surface. Hence the keyboard of the invention provides improved illumination characteristics.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
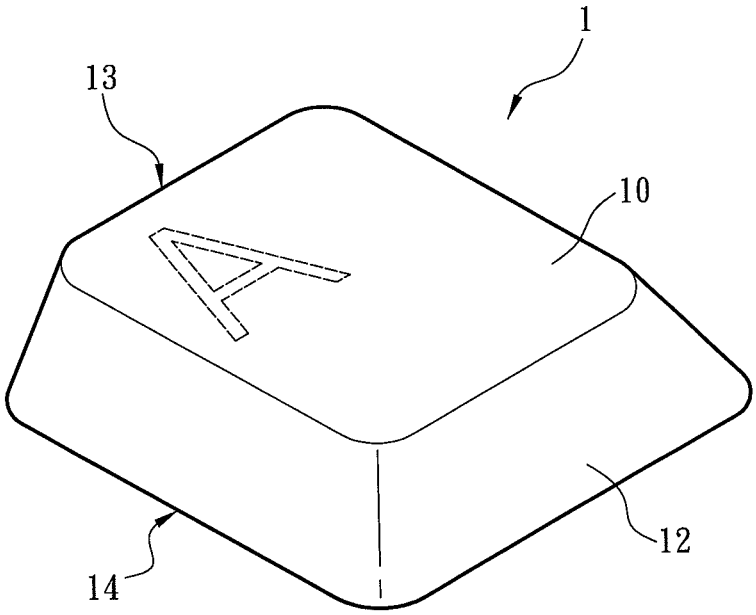
FIG. 1 is a perspective view of an embodiment of the keycap of the invention.
Figure 2:
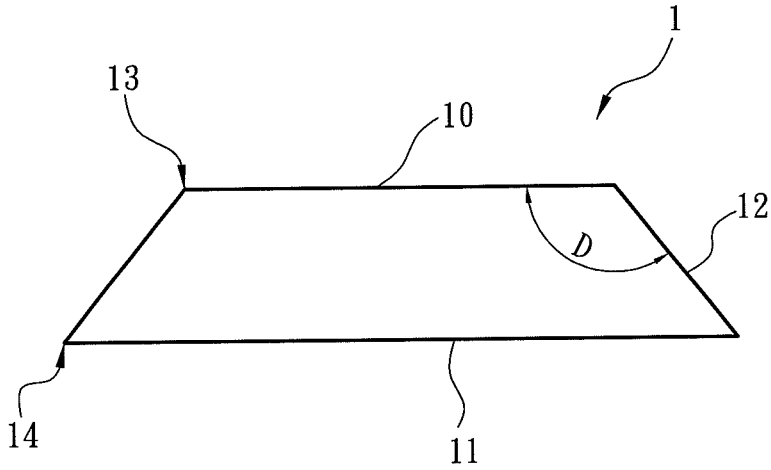
FIG. 2 is a side view of an embodiment of the keycap of the invention.

Please refer to FIGS. 1 and 2 for an embodiment of a keycap that emits light locally according to the invention. The keycap 1 is located in a keyboard 2, and includes an opaque press surface 10, a light incident surface 11 located below the press surface 10 to receive light, and at least one transparent light emitting surface 12 located between the press surface 10 and light incident surface 11 to emit light. The press surface 10 and light emitting surface 12 form an inclined angle D between them preferably greater than 90 degrees. Hence the light projecting to the light incident surface 11 is masked by the opaque press surface 10, but emits locally through the transparent light emitting surface 12. Holistically, light does not transmit through the opaque press surface 10 but emits the transparent light emitting surface 12 around the press surface 10. When light projects to the light incident surface 11, a light halo is formed around each keycap 1, thus making each keycap 1 in the keyboard 2 more distinguishable.

In one embodiment, the press surface 10 is coated with an opaque layer or made of an opaque material. The transparent light emitting surface 12 is preferably made of a transparent material. It is to be noted that the invention does not limit fabrication processes of the keycap 1. While the invention emphasizes that the press surface 10 is opaque, to make the character or notation on the press surface 10, such as character A, emit light in the dark, the keycap 1 also can include a transparent character or a transparent notation to allow the light to transmit through the press surface 10.

More specifically, the press surface 10 is surrounded by at least one top edge 13 connecting to each other. The light incident surface 11 is surrounded by at least one bottom edge 14 connecting to each other. The light emitting surface 12 is connected to the top edge 13 and bottom edge 14. In another embodiment the top edge 13 and bottom edge 14 include respectively four sets, hence the press surface 10 and light incident surface 11 are respectively quadrilateral. The light incident surface 11 is formed at an area greater than that of the press surface 10, hence the light emitting surface 12 is connected to the press surface 10 via the top edge 13 to form a hollow frustro-conical structure, but this is not the limitation of the invention.

Figure 3:
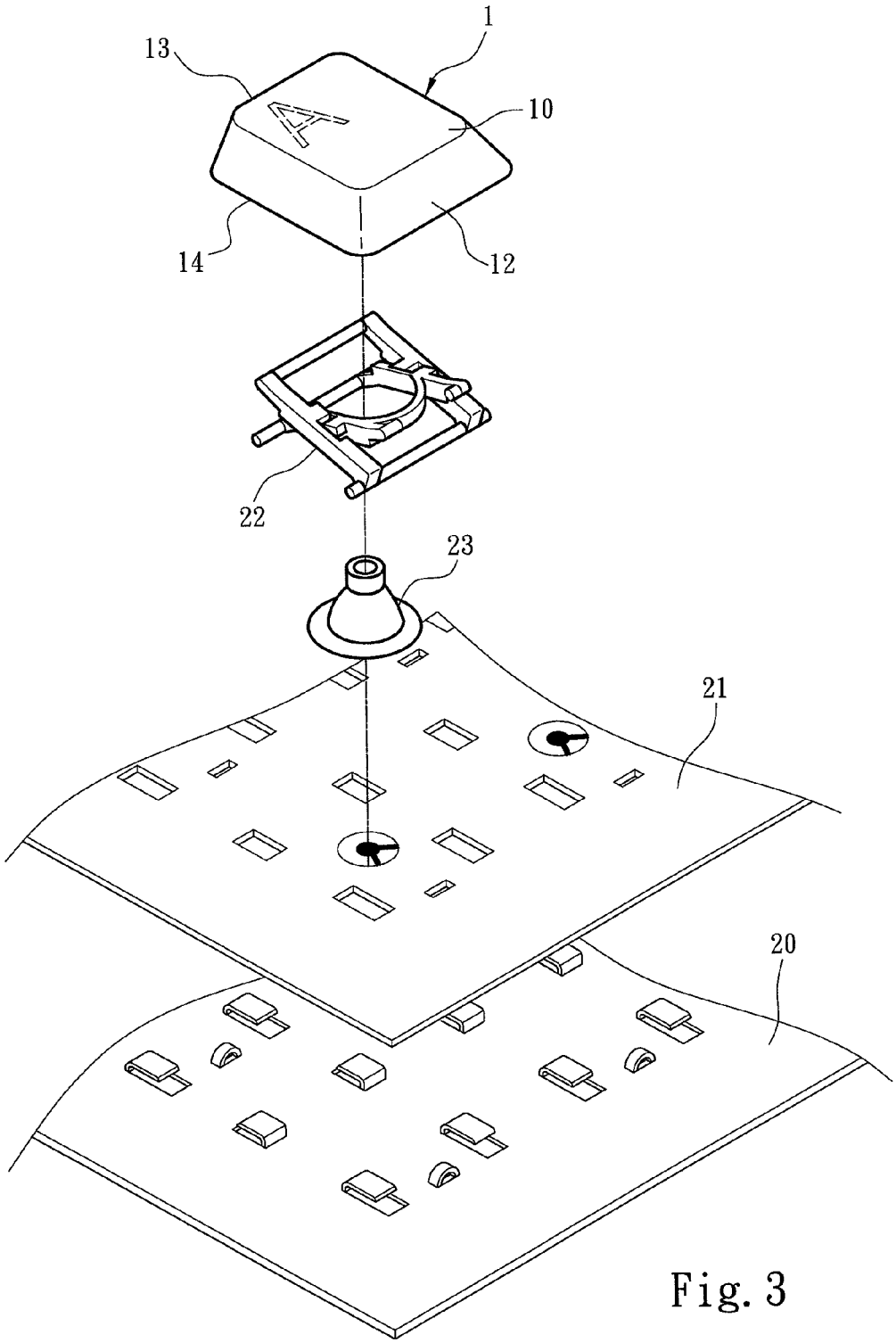
FIG. 3 is an exploded view of an embodiment of the keyboard of the invention.

Please refer to FIG. 3 for an embodiment of the keyboard of the invention, with the lighting unit omitted in the drawing. The keycap 1 of the invention is used on the keyboard 2. The keyboard 2 includes a baseboard 20 to hold the keycap 1, a command circuit board 21 located on the baseboard 20, a driven mechanism 22 to bridge the baseboard 20 and keycap 1, and an elastic element 23 located in the driven mechanism 22 to allow the keycap 1 to move vertically against the command circuit board 21 to trigger command circuit board 21.

Figure 4:
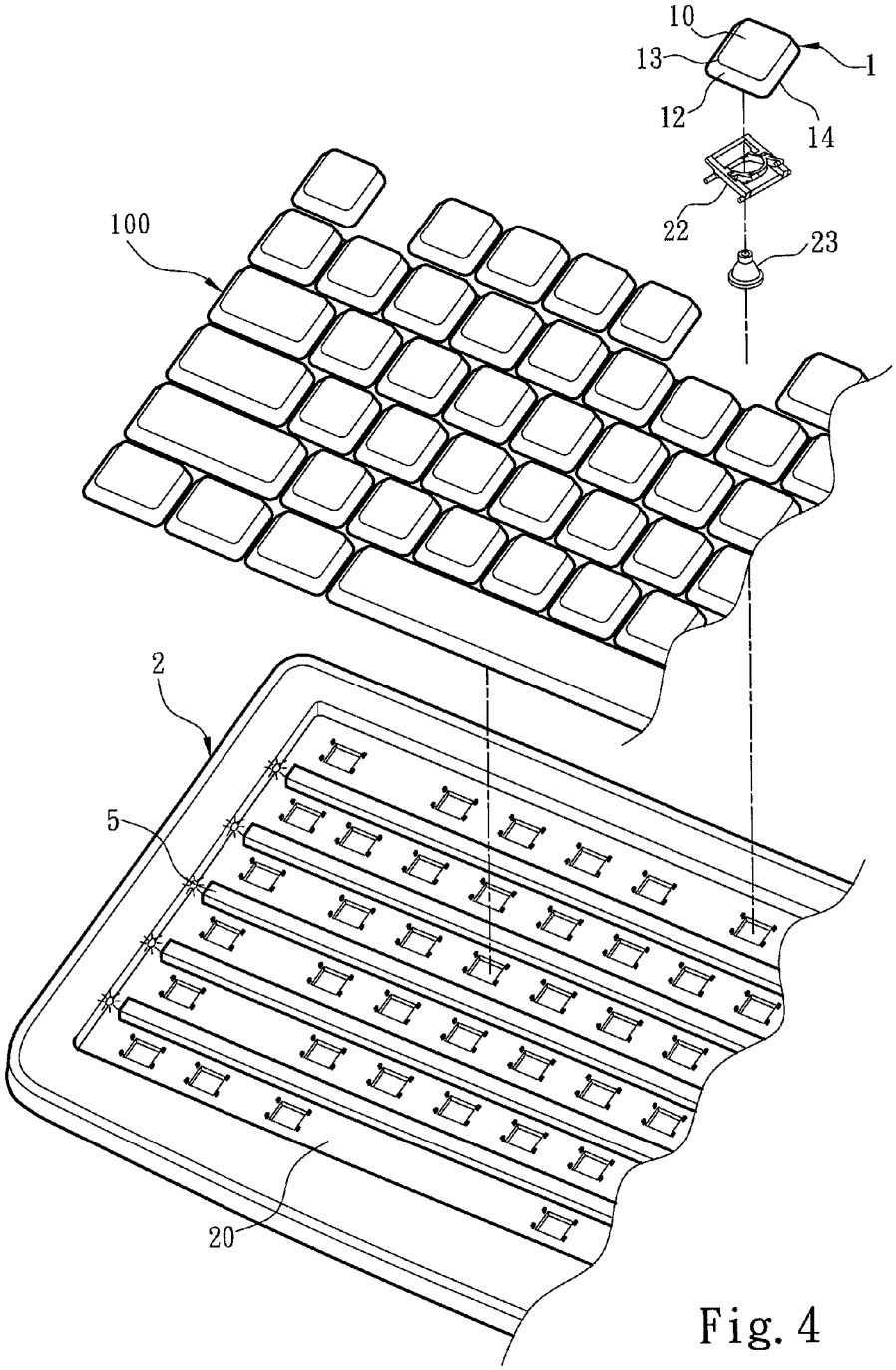
FIG. 4 is another exploded view of an embodiment of the keyboard of the invention.

Please also refer to FIG. 4, in this embodiment a lighting unit 5 is provided between the baseboard 20 and the keycap 1 to provide light for the keycap 1. The keyboard 2 includes a keycap cluster 100 including a plurality of keycaps 1 arranged in a row. The lighting unit 5 is located between any two neighboring key clusters 100. It is to be noted that the present invention does not limit the illumination mode of the keyboard. For instance, the lighting unit 5 can be located below the baseboard 20, or between the baseboard 20 and keycap 1 to provide light to the keycap 1, and both are adoptable illumination modes.

Figure 5:
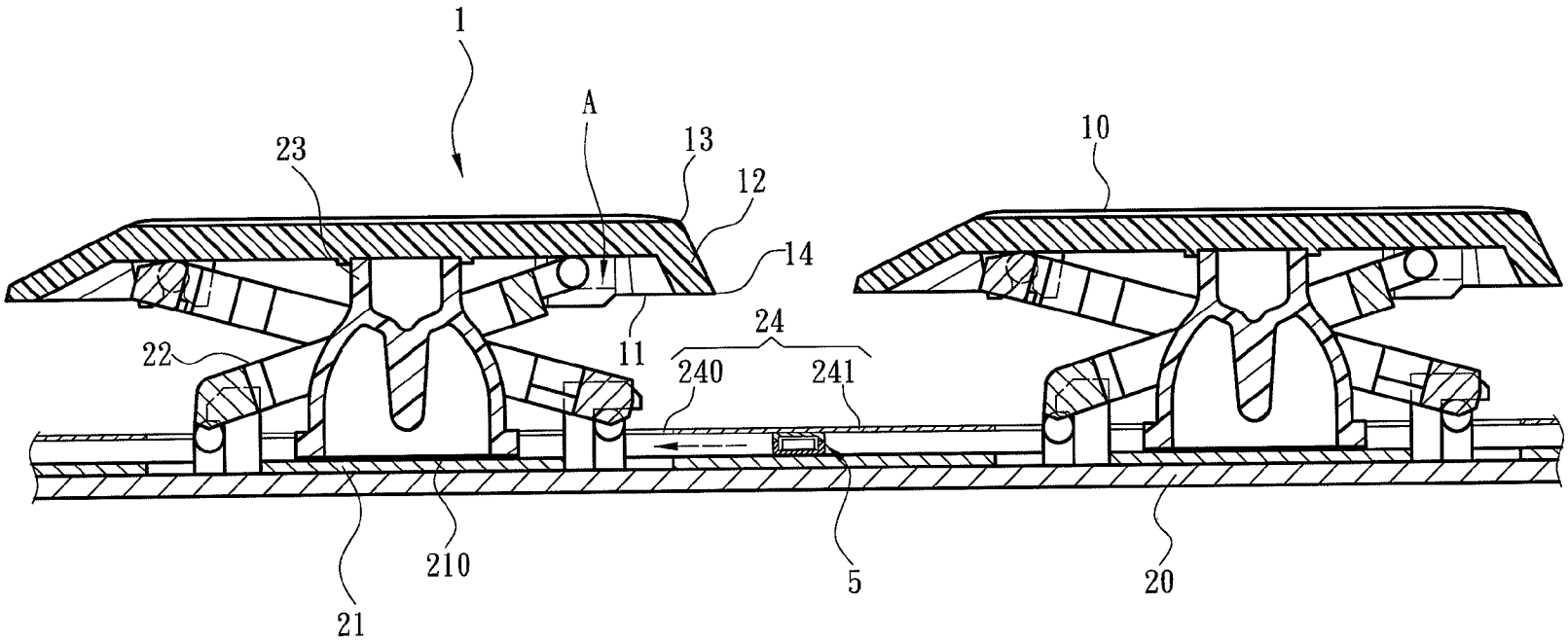
FIG. 5 is a cross section of an embodiment of the keyboard of the invention.

Please refer to FIG. 5 for an embodiment of the keyboard of the invention. The press surface 10, light incident surface 11 and light emitting surface 12 jointly define a light retaining zone A. The keyboard 2 further includes a light mask unit 24 located between the lighting unit 5 and keycap 1. The light mask unit 24 includes a transparent zone 240 located beneath the light incident surface 11 and formed at an area smaller than that of the light incident surface 11, and an opaque zone 241 outside the transparent zone 240. Because the area of the transparent zone 240 is smaller than that of the light incident surface 11, most of the light generated by the lighting unit 5 can directly and vertically project to the keycap 1 within the light incident surface 11, hence a greater portion of light can enter the light retaining zone A, thereby only a small portion of the light does not project to the light incident surface 11 but scatters outside. As a result, the light emitting surface 12 of the keycap 1 has a higher luminosity.

Figure 6:
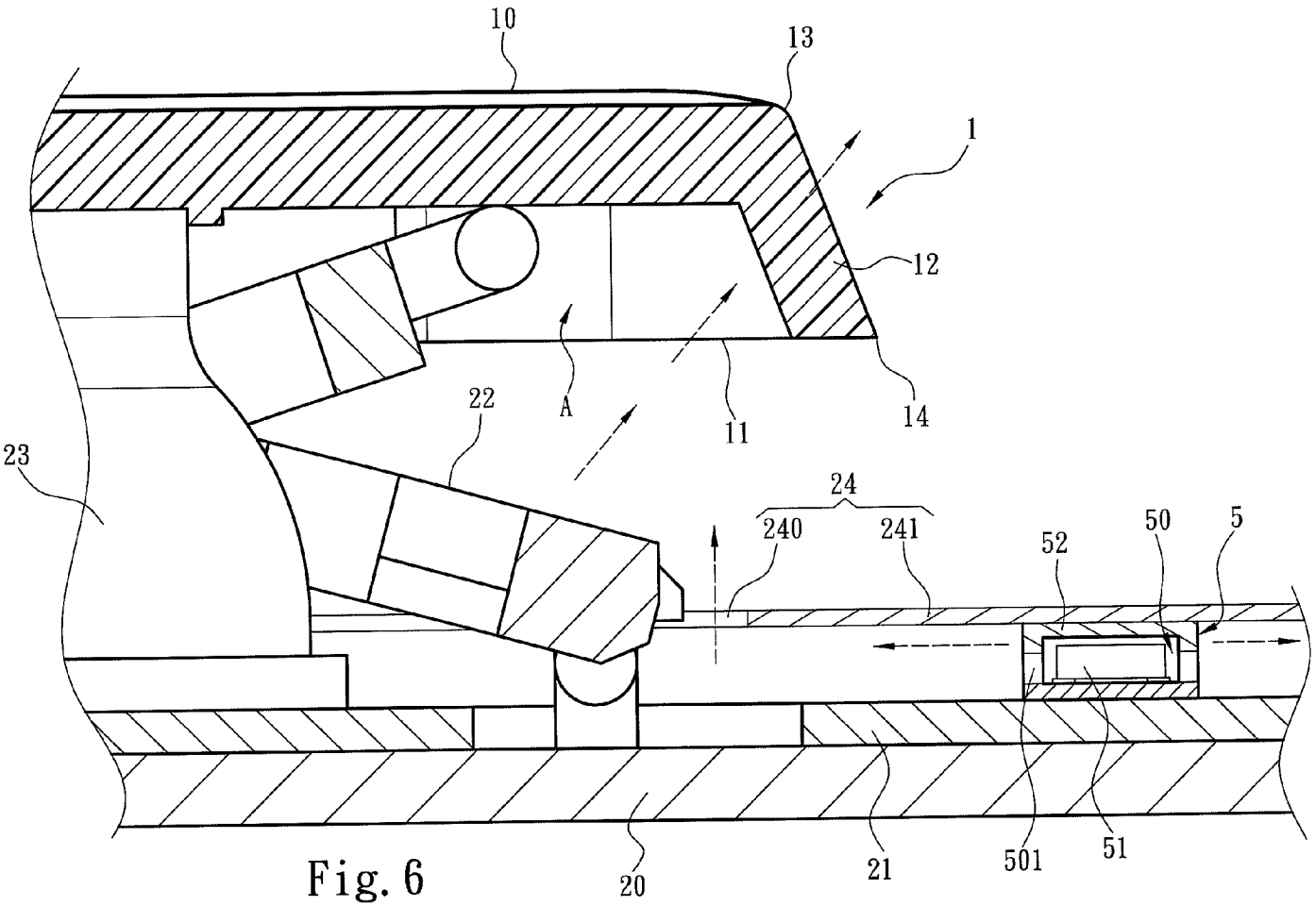
FIG. 6 is a cross section of an embodiment of the keyboard of the invention adopted a first type lighting unit.

Please refer to FIG. 6 for an embodiment of the keyboard employed a first type lighting unit according to the invention. The lighting unit 5 is located above the command circuit board 21. The light mask unit 24 is a light mask plate located between the command circuit board 21 and keycap 1. The lighting unit 5 includes a light transmission passage 50, a light emitting diode (LED) 51 located in the light transmission passage 50 and a light transmission element 52 covering the light transmission passage 50. In a preferred embodiment, the light transmission element 52 further includes a light projecting portion 501 corresponding to each keycap 1. The light transmission element 52 is made of a light transmission resin. Thus, when the light generated by the LED 51 is transmitted in the light transmission passage 50, it can project outwards through the light transmission element 52 and light projecting portion 501, and transmit between the baseboard 20 and opaque zone 241 of the light mask unit 24. The elastic element 23 and driven mechanism 22 also are preferably made of light condensing material to condense the light and allow the light to project to the light incident surface 11 of the keycap 1 through the transparent zone 240 of the light mask unit 24 to enter the light retaining zone A. The light is masked by the opaque press surface 10 but emits locally through the light emitting surface 12. Referring to FIG. 5, the command circuit board 21 can also selectively include a reflective portion 210 corresponding to the transparent zone 240.

Figure 7:
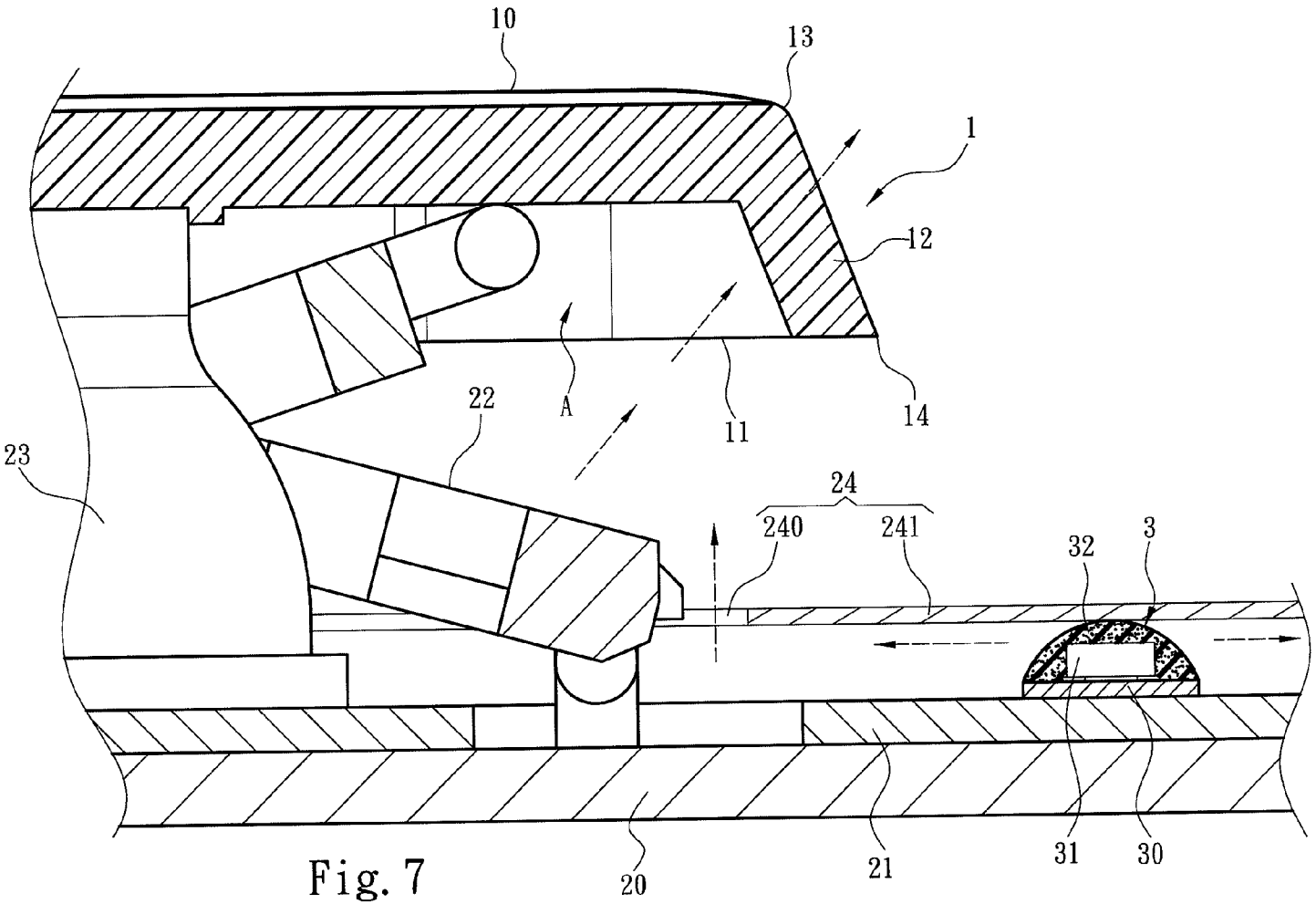
FIG. 7 is a cross section of an embodiment of the keyboard of the invention adopted a second type lighting unit.

Please refer to FIG. 7 for an embodiment of the keyboard employed a second type lighting unit according to the invention. The lighting unit 3 is located above the command circuit board 21. The light mask unit 24 is a light mask plate located between the command circuit board 21 and keycap 1. The lighting unit 3 includes a flexible circuit board 30, a plurality of LEDs 31 located on the flexible circuit board 30 and a protective resin layer 32 encased the LEDs 31. The LEDs 31 generate light to pass through the protective resin layer 32 and transmit between the opaque zone 241 of the light mask unit 24 and the flexible circuit board 30. The elastic element 23 and driven mechanism 22 are preferably made of light condensing material to condense light and allow the light to project to the light incident surface 11 of the keycap 1 through the transparent zone 240 of the light mask unit 24 to enter the light retaining zone A. The light is masked by the opaque press surface 10 but emits locally through the light emitting surface 12. It is to be noted that the light mask unit 24 previously discussed is a light mask plate to serve as an example, it also can be a light mask layer coated on the command circuit board 21.

As a conclusion, the keycap of the invention includes an opaque press surface, a light incident surface below the press surface to receive light, and at least one transparent light emitting surface located between the press surface and light incident surface to emit light. The press surface and light emitting surface form an inclined angle between them greater than 90 degrees. Compared with the conventional keycaps that project light outwards through the press surface, the press surface of the keycap of the invention masks the light projected from the light incident surface but allows the light to emit locally through the light emitting surface, hence a light halo is formed around the press surface, and the individual keycap of the illuminated keyboard is more distinguishable.

In addition, the invention also provides a light mask unit located beneath the light incident surface and formed at a smaller size than that of the light incident surface so that light generated by the lighting unit can project to the light incident surface through the transparent zone and enter the light retaining zone. Thereby only a small portion of the light cannot project to the light incident surface but scatters outside, and the light emitting surface of the keycap has a greater luminosity.

Furthermore, because the keycap of the invention does not emit light through the press surface, when users perform keystroke operation illumination of the keycap is not affected by masking of the press surface. Thus the keyboard of the invention also can improve illumination characteristics. In short, the present invention provides significant improvements over the conventional techniques.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A locally illuminated keycap located in a keyboard which includes a command circuit board that is located beneath the keycap and triggered by a vertical movement of the keycap to issue a keyboard command signal, and a lighting unit providing light and projecting the light to the keycap, comprising:

at least one top edge to form an opaque press surface, at least one bottom edge located below the press surface to form a light incident surface to receive the light, and at least one transparent light emitting surface connecting to the top edge and the bottom edge to emit light;

wherein the light emitting surface is located between the press surface and the light incident surface, the press surface and the light emitting surface forming an inclined angle therebetween greater than ninety degrees, the press surface, the light incident surface and the light emitting surface jointly forming a light retaining zone, the light generated by the lighting unit entering the light retaining zone and being masked by the opaque press surface to emit locally through the transparent light emitting surface.

2. The locally illuminated keycap of claim 1, wherein the keyboard further includes a light mask unit located between the lighting unit and the keycap.

3. The locally illuminated keycap of claim 2, wherein the light mask unit includes a transparent zone beneath the light incident surface and formed at an area smaller than that of the light incident surface such that the light generated by the lighting unit projects to the light incident surface through the transparent zone to enter the light retaining zone.

4. The locally illuminated keycap of claim 3, wherein the command circuit board includes a reflective portion corresponding to the transparent zone.

5. The locally illuminated keycap of claim 2, wherein the light mask unit is a light mask plate.

6. The locally illuminated keycap of claim 2, wherein the light mask unit is a light mask layer coated on the command circuit board.

7. The locally illuminated keycap of claim 1, wherein the press surface is coated with an opaque layer.

8. The locally illuminated keycap of claim 1, wherein the press surface is made of an opaque material.

9. The locally illuminated keycap of claim 1, wherein the light emitting surface is made of a transparent material.

10. The locally illuminated keycap of claim 1 further including a transparent character or a transparent notation to allow the light to transmit through the press surface.

11. The locally illuminated keycap of claim 1, wherein the keyboard further includes a baseboard to hold the keycap.

12. The locally illuminated keycap of claim 11, wherein the keyboard further includes a driven mechanism to bridge the baseboard and the keycap, and an elastic element located in the driven mechanism to allow the keycap to move up and down against the baseboard to trigger the command circuit board.

* * * * *